United States Patent [19]

Atkinson et al.

[11] Patent Number: 4,723,975

[45] Date of Patent: Feb. 9, 1988

[54] AIR SEPARATION METHOD AND APPARATUS

[75] Inventors: Timothy D. Atkinson; John T. Lavin, both of London, England

[73] Assignee: The BOC Group plc, Windlesham, England

[21] Appl. No.: 861,951

[22] Filed: May 12, 1986

[30] Foreign Application Priority Data

May 17, 1985 [GB] United Kingdom ..... 8512563

[51] Int. Cl.[4] ..... F25J 3/02

[52] U.S. Cl. ..... 62/29; 62/22; 62/32; 62/42

[58] Field of Search ..... 62/11, 22, 29, 32, 33, 62/36, 42; 55/66

[56] References Cited

U.S. PATENT DOCUMENTS

| | | | |
|---|---|---|---|
| 3,127,260 | 3/1964 | Smith | 62/29 X |
| 3,648,471 | 3/1972 | Basih et al. | 62/22 |
| 3,688,513 | 9/1972 | Streich et al. | 62/22 |
| 3,751,933 | 8/1973 | Balabaev et al. | 62/29 |
| 3,756,053 | 9/1973 | Yearout | 62/22 |
| 3,760,596 | 9/1973 | Basih et al. | 62/29 |
| 4,137,056 | 1/1979 | Golovko | 62/32 X |
| 4,372,765 | 2/1983 | Tamura et al. | 62/42 X |
| 4,575,388 | 3/1986 | Okada | 62/22 |
| 4,578,095 | 3/1986 | Erickson | 62/22 |

*Primary Examiner*—Albert J. Makay
*Assistant Examiner*—Steven E. Warner
*Attorney, Agent, or Firm*—R. Hain Swope; Chris P. Konkol; Larry R. Cassett

[57] ABSTRACT

In a method and apparatus for separating air a distillation zone is employed to separate air into an oxygen-enriched liquid fraction and a nitrogen-enriched vapor-fraction. A first stream is taken from the nitrogen-enriched vapor fraction and is mixed with a stream taken from the oxygen-enriched liquid fraction. At least part of the resultant mixture is employed to perform a refrigeration duty, for example the condensation of nitrogen-enriched vapor to provide reflux for the distillation column.

11 Claims, 1 Drawing Figure

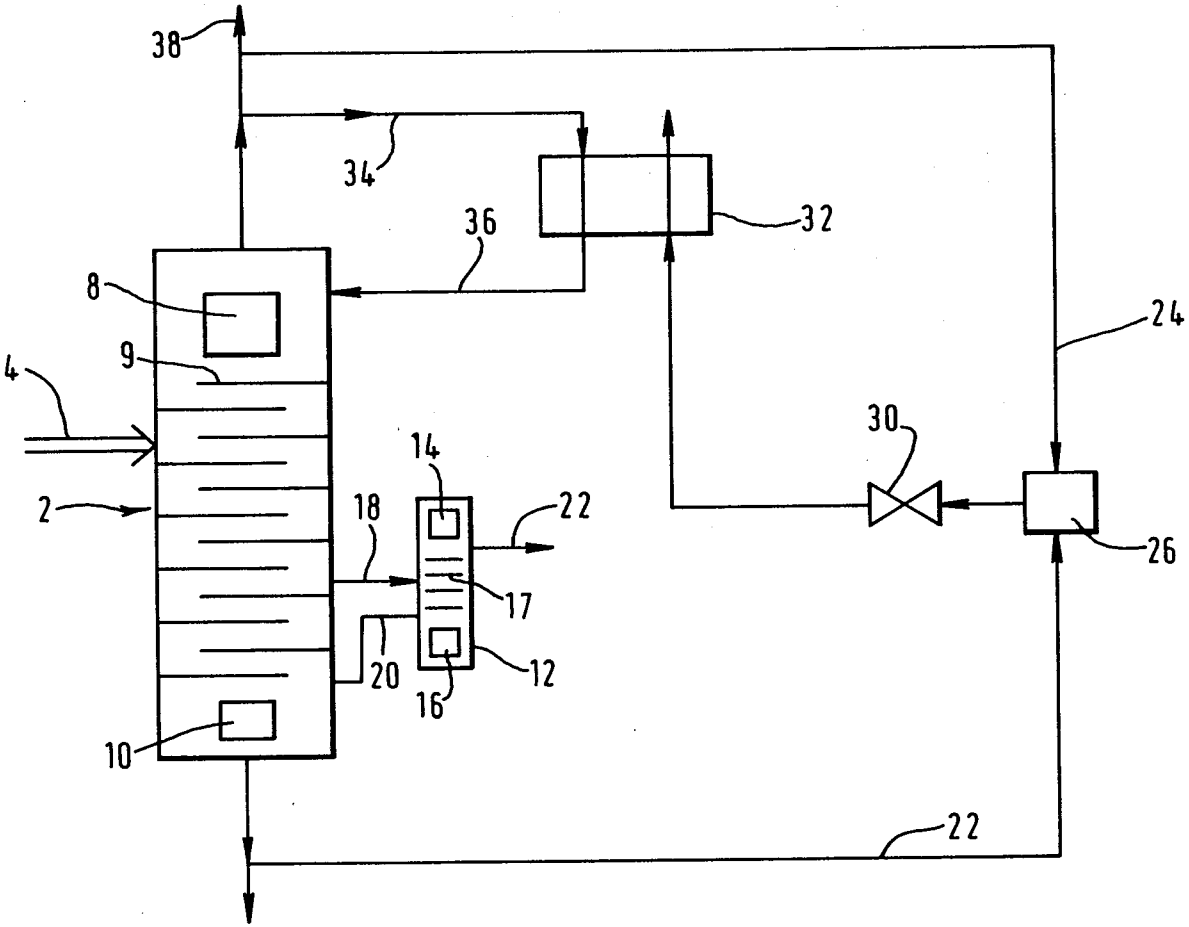
24
26
22
30
32
22
17
12
36
14
16
34
18
20
38
8
9
10
4
2

AIR SEPARATION METHOD AND APPARATUS

BACKGROUND OF THE INVENTION

This invention relates to a method and apparatus for the separation of air.

It is particularly concerned with the separation by fractional distillation of one or both of a nitrogen product and an argon product from air.

It is well known that by purifying and liquefying air and then subjecting the resulting liquid to fractional distillation, relatively pure oxygen and nitrogen fractions can be obtained. Moreover, in one intermediate region in the distillation system the concentration of argon in the vapour phase will be greater than its concentration in the incoming air for separation. Accordingly, it is also well known that an argon-rich product can be formed by subjecting the argon-enriched vapour to further fractionation in a separate column.

In order to enable the fractional distillation to take place, it is necessary to provide refrigeration to the distillation system. Moreover, if nitrogen is required as a product in the liquid phase it is necessary to provide refrigeration in order to liquefy the nitrogen.

When the vapour of a first component at a cryogenic temperature is mixed with the liquid of a second less volatile component at a cryogenic temperature, a net cooling effect is produced. Although this phenomenon has been observed previously, there has been no appreciation in the art that the phenomenon may be used with advantage in cryogenic air separation.

BRIEF DESCRIPTION OF THE DRAWINGS

The drawing shows in simplified form an air separation plant adapted to produce gaseous argon and gaseous nitrogen products.

DETAILED DESCRIPTION OF THE INVENTION

According to the present invention, there is provided a method of separating air including the steps of separating air in a distillation zone into an oxygen-enriched liquid fraction and a nitrogen-enriched vapour fraction, taking a first stream from said nitrogen-enriched vapour fraction and mixing it with a stream of oxygen-enriched liquid taken from said liquid fraction, and employing at least a part of the resultant mixture to perform a refrigeration duty.

The invention also provides apparatus for separating air, including a distillation system having an inlet for air. liquid-vapour means adapted to separate the air into an oxygen-enriched liquid fraction and a nirogen-enriched vapour fraction, means for withdrawing a stream of the oxygen-enriched fraction from distillation system, means for withdrawing first and second nitrogen-enriched vapour streams from the nitrogen-enriched vapour fraction in the distillation system, means for mixing the oxygen-enriched liquid stream with the first nitrogen-enriched vapour stream, and means for employing at least part of the resultant mixture to perform a refrigeration duty.

Preferably, at least part of the resultant mixture is heat exchanged with a second stream of nitrogen-enriched vapour to form liquid nitrogen.

At least some of the liquid nitrogen is preferably re-introduced into the distillation zone or system to provide reflux for such system. Such liquid nitrogen is preferably introduced directly into the liquid flowing through the distillation system, or alternatively may be employed as a coolant in a condenser associated with the distillation system to provide reflux for such system. In addition or alternatively, liquid nitrogen may be taken as product. In such examples it can be seen that the cold generated by mixing of the oxygen-enriched liquid stream with the first nitrogen-enriched vapour stream will provide refrigeration for the column or to form a liquid nitrogen product, or both.

Another alternative is to condense at least part of said mixture and to employ the condensate as reflux in the distillation zone.

The distillation zone or system typically comprises a single distillation column, a double distillation column or a plurality of columns. If desired, a nitrogen product may be taken from such column. In addition, an oxygen product may also be taken from the column.

The distillation system preferably also includes an auxiliary column cummunicating with said single or double column, in which a fluid fraction, preferably vapour, relatively richer in argon than the incoming air for separation is separated to produce an argon-rich gas as product. In such an example of the method and apparatus according to the invention, only the argon-rich gas may if desired be taken as product. This offers the advantage of significantly increasing the efficiency with which argon can be separated from air in comparison with conventional processes.

The mixture that is formed by mixing the oxgen-enriched liquid stream with the first nitrogen-enriched vapour stream, is preferably passed through an expansion valve upstream of said heat exchange with the second nitrogen-enriched vapour stream.

The method and apparatus according to the present invention will now be described by way of example with reference to the accompanying drawing which is a schematic diagram illustrating a plant for separating argon and nitrogen from air.

In the drawing, which illustrates an air separation plant in simplified form for purposes of clarity, a single distillation column 2 operating at a pressure of three atmospheres absolute has an inlet 4 compressed for air that has been purified (the purification including removal of water vapour, carbon dioxide and any hydrocarbons present in the air taken from the atmosphere) and at least partially liquefied by conventional means. The column 2 has a condenser 8 towards its top and a reboiler 10 towards its bottom. A plurality of liquid-vapour contact trays 9 are arranged intermediate the condenser 8 and the reboiler 10 whereby liquid from the condenser is caused to flow down the column in mass exchange with vapour formed by the reboiler 10. In operation, air is separated into a nitrogen-rich vapour fraction that collects at the top of the column 2 and an oxygen-rich liquid fraction that collects at the bottom of the column 2. Nitrogen vapour is condensed by the condenser 8 and liquid oxygen is vaporised by the reboiler 10. The necessary cooling for the condenser 8 and heating for the reboiler 10 is provided by a conventional heat pump cycle (not shown).

The distillation system illustrated in the drawing additionally includes an auxiliary column 12 provided with a condenser 14 and typically a reboiler 16 with liquid-vapour contact trays 17 disposed therebetween whereby vapour whose concentration of argon is greater than that in the incoming air for separation withdrawn from the column 2 through conduit 18 is separated into an oxygen-rich liquid that is returned via conduit 20 to the column 2 and an argon-rich vapour fraction that is taken as product from the column 12 through the outlet 22 above the uppermost tray thereof.

Liquid oxygen is withdrawn from the bottom of the column 2 at a temperature of approximately 102K through a conduit 22 and is passed into a chamber 26 where it is mixed with a first portion of a gaseous nitrogen stream at a temperature of 88K withdrawn from the top of the column 2 and passed through a conduit 24 into the chamber 26. Mixing is typically effected by bubbling the nitrogen vapour through the liquid oxygen in the chamber 26 and the chamber 26 is in effect a phase separator operated in reverse. The resulting mixture is withdrawn as a vapour-liqud mixture at a temperature of about 91K and a pressure of about 3 atmospheres from the chamber 26 and expanded through an expansion valve 30 into one pass of a heat exchanger 32 at a pressure of about 1.5 atmospheres and a temperature of about 85.5K where it is employed to condense a second portion of the stream of vapourous nitrogen taken from the top of the column 2 and passed into the heat exchanger 32 via a conduit 34. The resulting liquid nitrogen condensate passes from the heat exchanger 32 through conduit 36 into the top of the chamber 2 where it augments the reflux provided by the condenser 8. After passage through the heat exchanger 32 the mixed oxygen-nitrogen stream is typically employed to provide cooling for the incoming air so as to assist in its liquefaction prior to its introduction into the column 2.

A third portion of the stream of vaporous nitrogen taken from the top of the column 2 is typically passed to an outlet 38 from which it is taken from the plant as product nitrogen.

Cooling for the condenser 14 of the auxiliary column 12 and heating for the reboiler 16 of the column may for example be provided by a conventional heat pump circuit which is not shown for purposes of clarity of illustration.

The mixing of the oxygen stream with the nitrogen stream in the chamber 26 produces a net reduction in the temperature and this refrigeration effect by being employed to produce liquid nitrogen reflux for the column 2 reduces the heat pumping duty that the heat pumping circuit for the column 2 needs to perform. Accordingly, the overall separation efficiency of the argon is increased without there being any loss of argon yield.

If desired, the temperature of one or both of the first nitrogen- rich vapour stream and the oxygen-rich liquid stream that are mixed in the chamber 26 may be adjusted by heat exchange upstream of the chamber 26. The mixture produced in the chamber 26 may if desired be sub-cooled upstream of the expansion valve 30.

An oxygen product may if desired be taken from the oxygen-rich liquid stream.

We claim:

1. A method of separating air comprising separating air in a distillation zone to form an oxygen-enriched liquid fraction and a nitrogen-enriched vapour fraction, mixing a vapour stream from said nitrogen-enriched vapour fraction with a stream of oxygen-enriched liquid from said liquid fraction, and utilizing at least a part of the resultant mixture to form liquid nitrogen by heat exchange with a second stream of nitrogen-enriched vapour.

2. A method according to claim 1, in which at least some of liquid nitrogen is reintroduced into the distillation zone to provide reflux therefor.

3. A method according to claim 1, in which at least some of the liquid nitrogen is employed as a coolant in a condenser associated with the distillation system to provide reflux for such system.

4. A method according to claim 1, in which the mixture is passed through an expansion valve upstream of its heat exchange with the second nitrogen-enriched vapour stream.

5. A method according to claim 1, in which at least some of the liquid nitrogen is taken as product.

6. A method according to claim 1, in which the distillation zone includes a column in which an argon-rich fraction is formed.

7. Apparatus for separating air, including a distillation system having an inlet for air, liquid-vapour means adapted to separate the air into an oxygen-enriched vapour fraction, means for withdrawing a stream of the oxygenenriched fraction from the distillation system, means for withdrawing first and second nitrogen-enriched vapour streams from the nitrogen-enriched vapour fraction in the distillation system, means for mixing the oxygen-enriched liquid stream with the first nitrogen-enriched vapour stream, and means for forming liquid nitrogen by heat exchange of at least some of the resulting mixture with said second nitrogen-enriched vapour stream.

8. Apparatus according to claim 7, additionally including means for reintroducing at least some of the liquid nitrogen into the distillation system to provide reflux for such system.

9. Apparatus according to claim 7, additionally including a condenser associated with the distillation system to provide a reflux utilizing at least some of the liquid nitrogen in the condenser as a coolant.

10. Apparatus according to claim 7, additionally including an expansion valve intermediate said mixing means and said heat exchanger.

11. Apparatus according to claim 7, in which the distillation system includes a column which in operation produces an argon-rich product.

* * * * *